US007785243B2

(12) United States Patent
Kassel

(10) Patent No.: US 7,785,243 B2
(45) Date of Patent: Aug. 31, 2010

(54) RESISTANCE TRAINING EXERCISE DEVICE, SYSTEM AND METHOD

(75) Inventor: Blake Kassel, Boca Raton, FL (US)

(73) Assignee: Bodylastics Int., Inc., Boca Raton, FL (US)

( * ) Notice: Subject to any disclaimer, the term of this patent is extended or adjusted under 35 U.S.C. 154(b) by 0 days.

(21) Appl. No.: 12/344,798

(22) Filed: Dec. 29, 2008

(65) Prior Publication Data

US 2010/0167884 A1 Jul. 1, 2010

(51) Int. Cl.
*A63B 21/02* (2006.01)

(52) U.S. Cl. ..... 482/122; 482/121; 482/126

(58) Field of Classification Search ..... 482/122, 482/124, 126, 129, 904, 121; 119/769, 770, 119/792, 798
See application file for complete search history.

(56) References Cited

U.S. PATENT DOCUMENTS 5,052,365 A * 10/1991 Carella ..... 124/90
5,167,601 A * 12/1992 Frappier ..... 482/121
5,743,838 A * 4/1998 Willis ..... 482/124
5,800,322 A 9/1998 Block
5,807,218 A * 9/1998 Nagatomo ..... 482/124
7,004,892 B2 * 2/2006 Marco ..... 482/124
2003/0045408 A1 * 3/2003 Seles ..... 482/121
2004/0180767 A1 * 9/2004 Carmel et al. ..... 482/126
2005/0137066 A1 * 6/2005 Wu ..... 482/126
2006/0073954 A1 * 4/2006 Block et al. ..... 482/121
2007/0101950 A1 * 5/2007 Medlin ..... 119/792

* cited by examiner

*Primary Examiner*—Loan Thanh
*Assistant Examiner*—Allana Lewin
(74) *Attorney, Agent, or Firm*—Dan M. DeLaRosa

(57) ABSTRACT

A resistance training exercise device, system and method having at least one elastic, elongated and hollow cord with a tether secured to each end of the cord, a strain relief sleeve and a clip secured to the free end of each tether, each tether being secured to their respective end of the cord by a grommet, plug and sleeve and each clip preferably comprising an o-ring that receives the free end of the tether and a spring-loaded biasing flange for clipping onto a handle, strap or the cord itself.

19 Claims, 7 Drawing Sheets

RESISTANCE TRAINING EXERCISE DEVICE, SYSTEM AND METHOD

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a resistance training exercise device and method, and more particularly, to a resistance training exercise device and method employing interchangeable handles and straps for facilitating a variety of different exercises regardless of location.

2. Description of the Background Art

Resistance training is a popular form of exercise. Resistance training exercise devices known consist of a stretchable tube or cord with a pair of handles secured to opposing ends of the tube. To use this type of device, the user holds the handles and repeatedly stretches the tube, increasing the tension force in the tube, and retracts the tube while maintaining tension in the tube. However, resistance training devices such as these are very limited in application and structure.

The problem with conventional resistance training tubes is that the handles are connected the tube. For instance, U.S. Pat. No. 5,800,322, issued to Block, discloses an exercise device having a stretchable and elongated tube with a pair of handles secured to respective ends of the tube. As the handles are secured directly to the tube, the tube can only be used with those handles and cannot be replaced with different handles or straps or secured to a stationary object, such as a door knob or wall hook, to accommodate a variety of exercises. In addition, if the handle or tube breaks the entire device must be replaced. Moreover, connecting a handle directly to a tube raises structural integrity issues. If a resistance training exercise cord device and system existed that accommodated the universal use of a plurality of different handles and straps with interchangeable cords of varying levels of elasticity to change the work load, it would be more cost effective and versatile compared to conventional devices and, hence, well received. Unfortunately, there are no known resistance training exercise devices or systems that effectively and adequately meet these parameters. Accordingly, there exists a need for such a device and system. The instant invention addresses this unfulfilled need in the prior art by providing a resistance training exercise device, system and method as contemplated by the instant invention disclosed herein.

The instant invention provides a resistance training exercise device, system and method comprising at least one elastic, elongated and hollow cord with a tether secured to each end of the cord and a clip secured to the free end of each tether. The cord comprises a rubber or rubber like material having a predetermined level of elasticity. It is the level of elasticity that dictates the tension force of the cord in pounds. Accordingly, the cord is assigned an average workout weight in pounds, which is marked on the cord's corresponding clip. Each tether is secured to their respective end of the cord by a grommet, plug and sleeve. The plug is inserted in each cord end to prevent the grommet from slipping off the cord. The sleeve fits around the plug and the end of the cord containing the plug. The sleeve may comprise a separate component or the end of the cord folded back over itself and the plug. The clips preferably comprise an o-ring that receives the free end of the tether and a spring-loaded biasing flange for clipping onto a handle, strap or the cord itself. The handles and straps each comprise an o-ring for clasping by the clip. The handles are preferably covered with foam for comfort. Likewise, the straps are preferably padded for comfort.

The system of the instant invention preferably comprises a plurality of cords with a clip tethered to each end, plurality of handles, and plurality of ankle or wrist straps. Each cord comprises a different level of elasticity or tension force measured in pounds for facilitating a desired workout. Each cord is preferably color coded to indicate the "weight" of the cord. The system of the instant invention may further comprise a travel bag, user manual, workout guide and, or training video or DVD.

The method of resistance training in accordance with the instant invention comprises various exercises utilizing one or more cords and one or more handles or straps. The handles are used for stretching the cord with the hands. The straps are mounted to the wrists, ankles or stationary objects for stretching the cord. The user first determines the exercise to be performed. The user may reference the manual and guide for determining and designing exercise routines. Based on the exercise, the appropriate cord and handles or straps are selected and clipped to the tether or a clip may be clipped to the cord. Once the cord is properly prepared, a variety of exercises may be performed by stretching the cord and slowing retracting the cord to controllably release tension. For instance, the user may grasp a handle with each band and stretch and slowly retract the cord across the chest, or stand in the middle of the cord and stretch the cord upward and outward. The user may clip one end of the cord to a door handle or hook and grasp a handle at the other end with one hand for repeatedly stretching the cord by pulling outward. The user may clip one end of the cord to a door handle or door anchor device and secure an ankle strap to the cord at the other end and place it around an ankle for repeatedly stretching the cord by moving the leg outward. The cord may be secured to a stationary object at one end by wrapping it around the stationary device and clipping it to itself.

In one embodiment, the present invention provides for an exercise device comprising: a stretchable cord having opposing first and second ends, the cord has an internal cavity and an external surface; at least two plugs, each plug is inserted within the internal cavity of the cord adjacent the first and second ends of the cord; at least two sleeves, each of the sleeves being placed over the external surface of the cord adjacent the first and second ends of the cord, each of the plugs is situated within a length of each of the sleeves; at least two tethers, each of the tethers has a stitched portion, the stitched portion forming two opposing compartments, a first compartment having at least one grommet and is designed to received at least one end of the cord with the sleeve and the plug, the grommet has a circumference that is smaller than a circumference of the cord with the sleeve, and the plug with at least a portion of said cord and at least a portion of said sleeve is situated generally within the first compartment of the tether; at least two carabineers, each of the carabineers has a bottom portion and a gate element; and at least two O-rings situated within each of the bottom portions of each of the carabineers, each of the O-rings is designed to receive a portion of the second compartment of each of the tethers.

In another embodiment, the present invention relates to a resistance exercise device comprising: a stretchable cord having opposing first and second ends, the cord has an internal cavity and an external surface; at least one plug is inserted within the internal cavity of the cord adjacent the first end of the cord; at least one sleeve is placed over the external surface of the cord adjacent the first end of the cord, the plug is situated within a length of the sleeve; at least one tether having a stitched portion, the stitched portion forms two opposing compartments, a first compartment has at least one grommet and is designed to received at least one end of the cord with the sleeve and the plug, the plug with at least a portion of the cord and at least a portion of the sleeve is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

In a further embodiment, the present invention relates to a resistance exercise device comprising: a stretchable cord has opposing first and second ends, the cord has an internal cavity and an external surface, each of the first and second ends is folded over itself to create double layered ends; at least one plug is inserted within the internal cavity of the cord adjacent the first end of the cord, the plug is situated within a length of the double layered cord; at least one tether has a stitched portion, the stitched portion forms two opposing compartments, a first compartment has at least one grommet and is designed to received at least one end of the cord with the plug, the plug with at least a portion of the cord and at least a portion of the double layered cord is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

BRIEF DESCRIPTION OF THE SEVERAL VIEWS OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
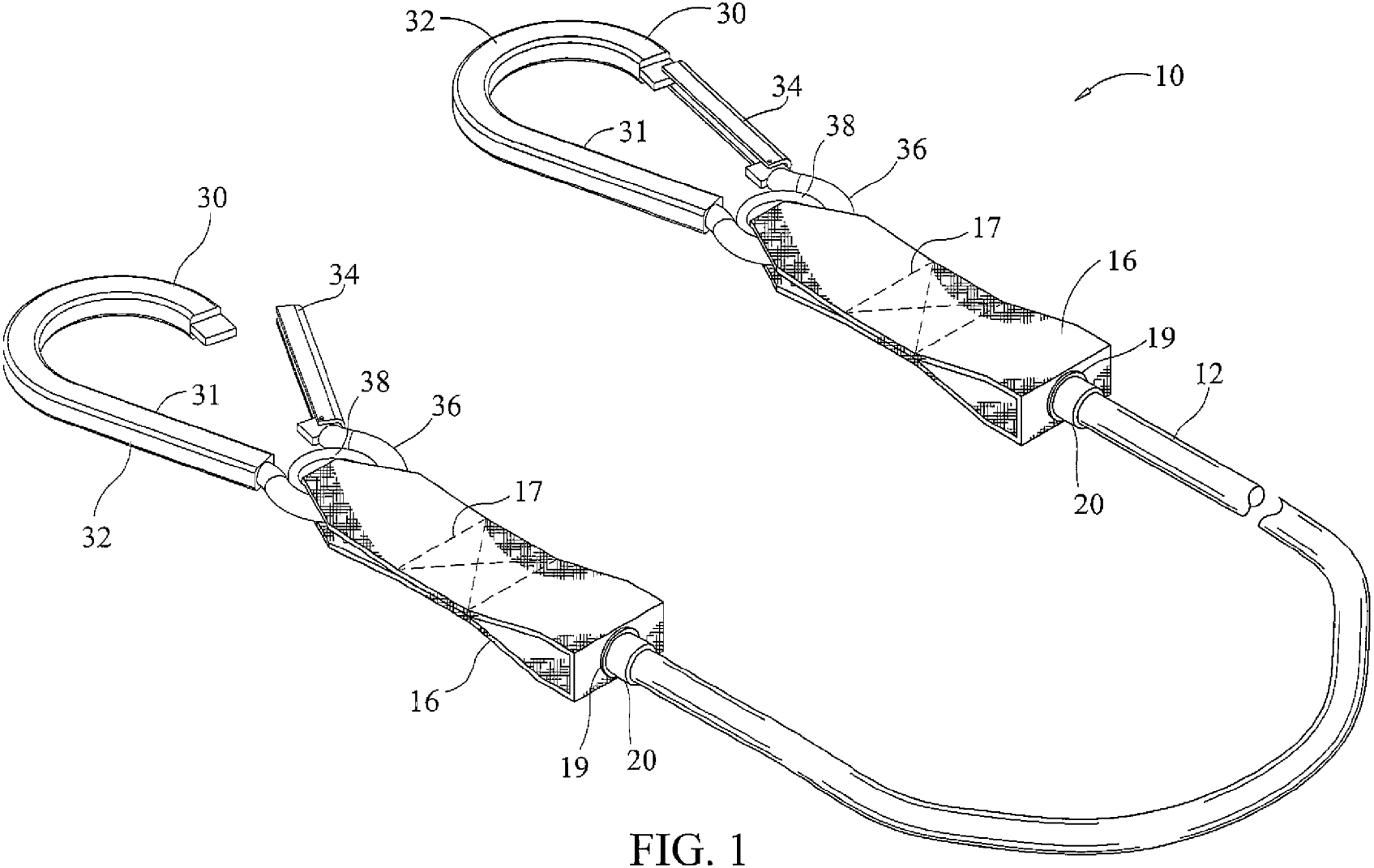
FIG. 1 is a perspective view of the resistance training exercise device in accordance with the preferred embodiment of the instant invention.
Figure 2:
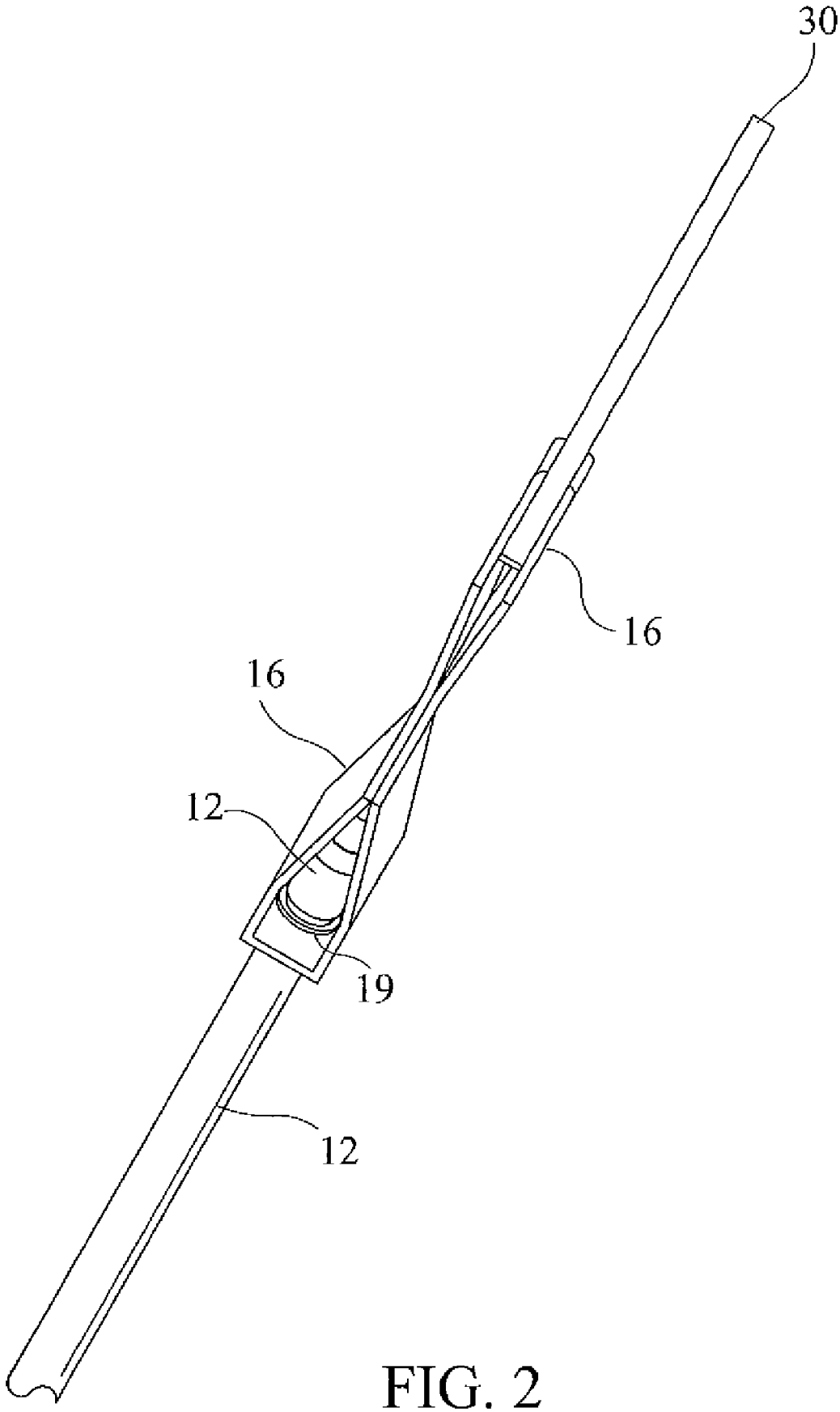
FIG. 2 is a side perspective view of the resistance training exercise device in accordance with the preferred embodiment of the instant invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

With reference to the drawings, FIGS. 1 to 9 depict various embodiments of the instant invention which is generally referenced as a resistance training exercise device, system or method and, or by numeric character 10. The instant invention 10 comprises a resistance training exercise device, system and method that enables multiple exercises by providing and facilitating use of a plurality of interchangeable cords, handles and straps.

With reference to FIGS. 1-9, the resistance training exercise device 10 of the instant invention comprises an elastic, elongated and hollow cord 12, a tether 16 secured to each end of the cord 12 and a clip 30 secured to the free end of each tether 16. The cord 12 comprises a rubber or rubber like material having a predetermined level of elasticity corresponding to the amount of pulling force needed to stretch the cord a certain distance. The level of elasticity resistance in the cord dictates the tension force of the cord, which is represented in pounds. Accordingly, the cord 12 is designed with an average workout weight in pounds based on the cords modules of elasticity, which is indicated on the cord's corresponding clip 30 by indicia 31. The tethers 16 preferably comprise a nylon or nylon-like material that is secured to a corresponding cord 12. The tethers 16 are sewn with stitching 17 in a mid-section to form a loop at each end for receiving and holding a corresponding clip 30 end and cord end 12, respectively. A clip 30 is secured to the free end of each tether 16 for attaching to a handle 40, ankle or wrist strap 50, rope, bar or other attachment or to the cord 12. The handle 40 preferably comprises an o-ring 42 for connecting to the clip 30, a support extension 43 with a loop for receiving and containing the o-ring 42 and a foam pad 44 around the gripping portion of the handle 40. Likewise, the ankle or wrist strap 50 preferably comprises an o-ring 52 for connecting to the clip 30, a support extension 53 with a loop for receiving and containing the o-ring 52 and a padded belt 54 for receiving and engaging an ankle or wrist.

Figure 3:
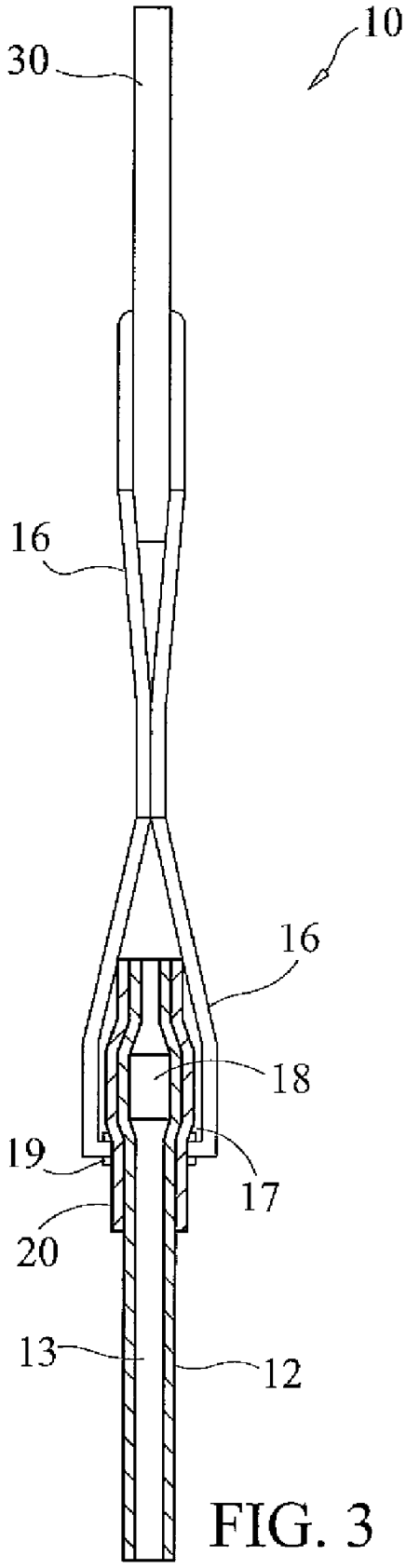
FIG. 3 is a partial cross-sectional view and elevational view of the resistance training exercise device in accordance with the preferred embodiment of the instant invention.
Figure 4:
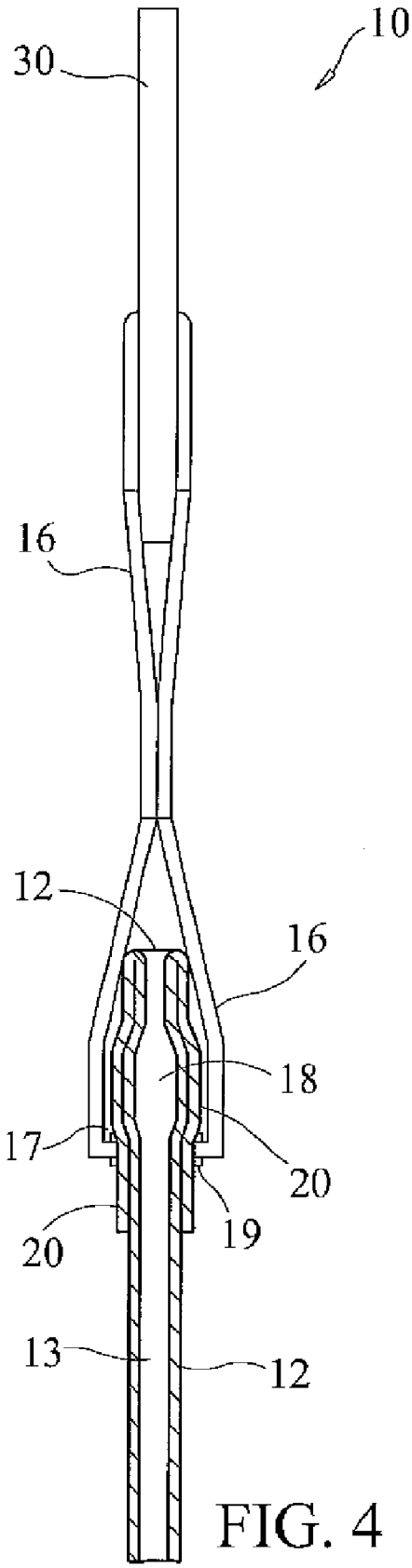
FIG. 4 is a partial cross-sectional view and elevational view of the resistance training exercise device in accordance with the alternative embodiment of the instant invention.
Figure 5:
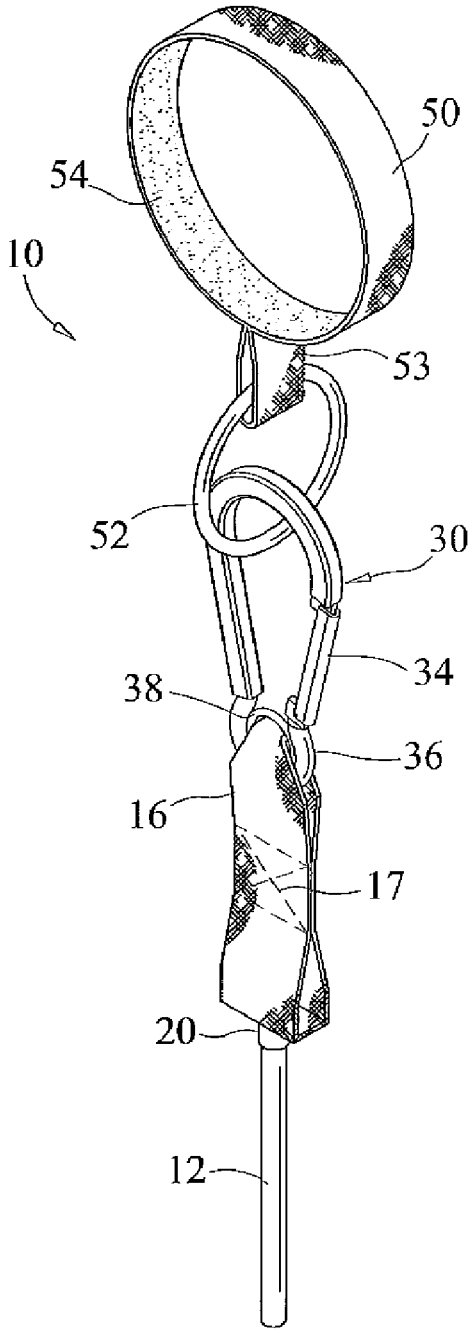
FIG. 5 is a perspective view of the resistance training exercise device with an ankle or wrist strap in accordance with the preferred embodiment of the instant invention.
Figure 6:
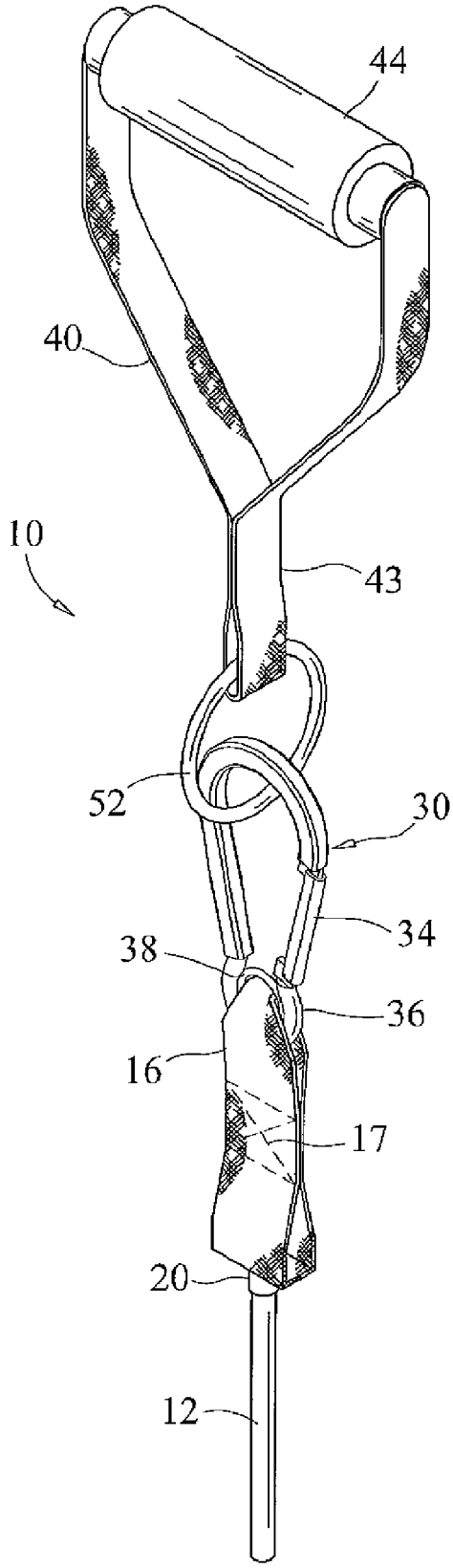
FIG. 6 is a perspective view of the resistance training exercise device with a handle in accordance with the preferred embodiment of the instant invention.

Referring to FIGS. 3 and 4, the tethers 16 are each secured to its respective end of the cord 12 by a grommet 19, plug 18 and strain-relief sleeve 20. The plug 18 is inserted in the hollow passage 13 of each cord 12 proximal one end to block the grommet 19 from slipping off the cord. The sleeve 20 fits tightly over the end of the cord 12 containing the plug 18 to reinforce the cord 12 and plug 18 and increase its stress and strain tolerance. The sleeve 20 preferably comprises an elastic sleeve that stretches and mounts over the cord 12 segment containing the plug 18 conforming to its shape to reinforce and increase the tolerance level of stress, strain and, or sheering forces, as shown in FIG. 3. In an alternative embodiment, the sleeve 20 may be formed by and comprise a portion of the cord 12 folded back over its segment containing the plug 18 in a manner that conforms to the cord 12 and plug 18 to enhance the tolerance level of strain, stress and, or sheer forces, as shown in FIG. 4.

With reference to FIGS. 1-9, the clips 30 comprise a hooked body 32, a spring-loaded or biasing member 34 pivotally secured in or over the opening of the hook body 32 to a smaller arcuate tether end 36 that receives and supports a corresponding end of the tether 16. The tether end 36 may contain an o-ring 38 in its opening that receives the same tether end for reinforcement and smooth support of the tether 16 in a manner that reduces friction and the risk of damage during exercise. Access to the opening in the clip 30 is controlled by the biasing member 34, which facilitates clipping to a handle 40 or strap 50. The handle o-ring 42 or strap o-ring 52 passes through the biasing member 34 and slides over the clip body 32.

Figure 7:
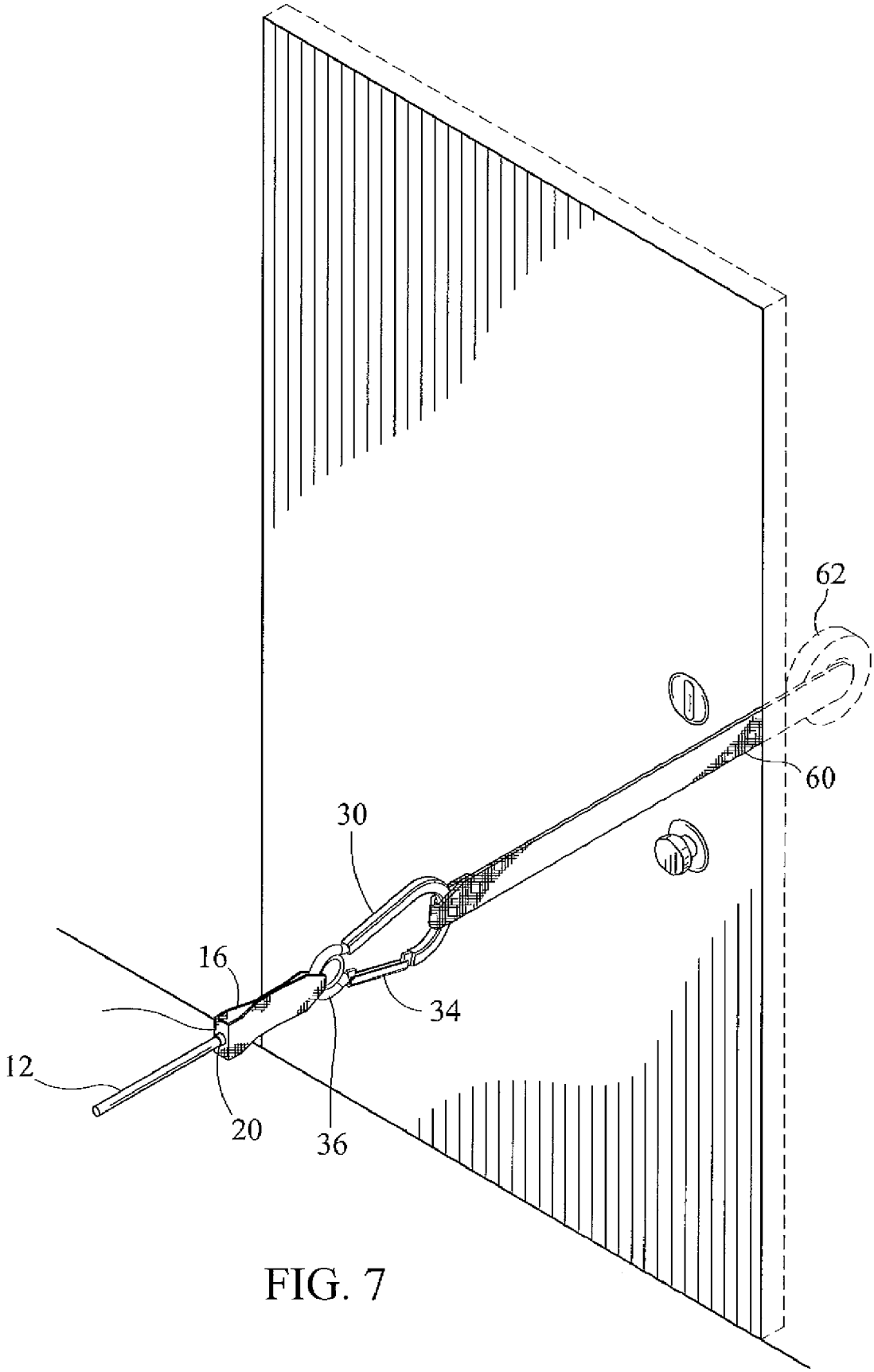
FIG. 7 is a perspective view of the resistance training exercise device with an anchor strap secured to a door in accordance with the preferred embodiment of the instant invention.

With reference to FIGS. 1-9, the resistance training exercise system 10 of the instant invention comprises a plurality of cords 12 with a tether 16 and clip 30 at each end, plurality of handles 40 and plurality of ankle or wrist straps 50, bars and, or ropes. The system 10 may comprise an anchor strap 60 with an anchor 62, as shown in FIG. 7. As shown, the anchor 62 comprises a disk secured by or mounted to the anchor end of the strap 60. Each cord 12 comprises a different level of elasticity resistance or tension force measured in pounds for facilitating various levels of resistance in accordance with desired workouts. Each cord 12 is preferably color coded to indicate the "weight" of the cord 12, which may also be set forth by indicia 31 on the clip 30. The system of the instant invention 10 may further comprise a travel bag, user manual, workout guide and, or training video or DVD.

Figure 8:
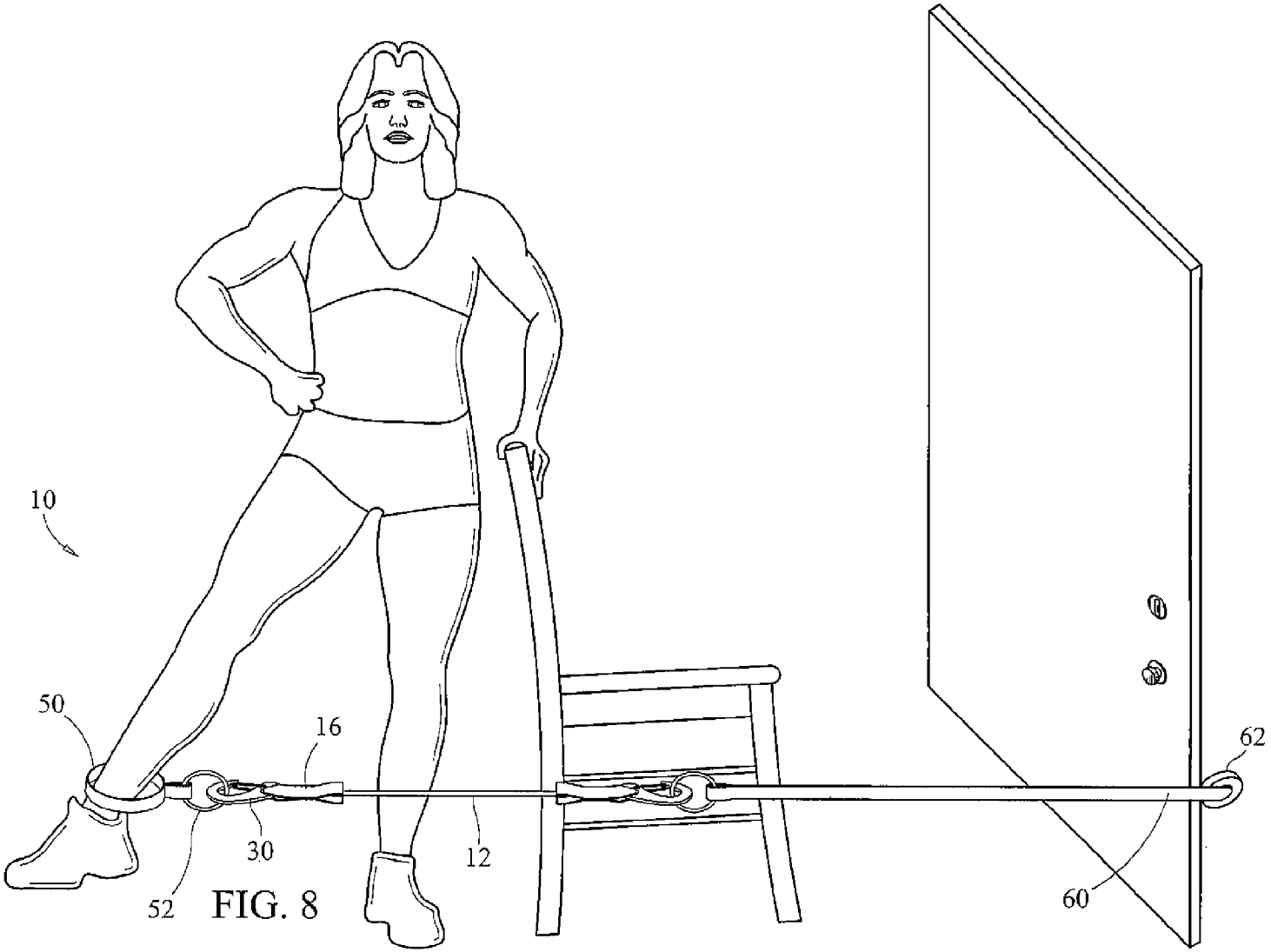
FIG. 8 is a perspective view of the resistance training exercise device with an ankle or wrist strap in use in accordance with the preferred embodiment of the instant invention.
Figure 9:
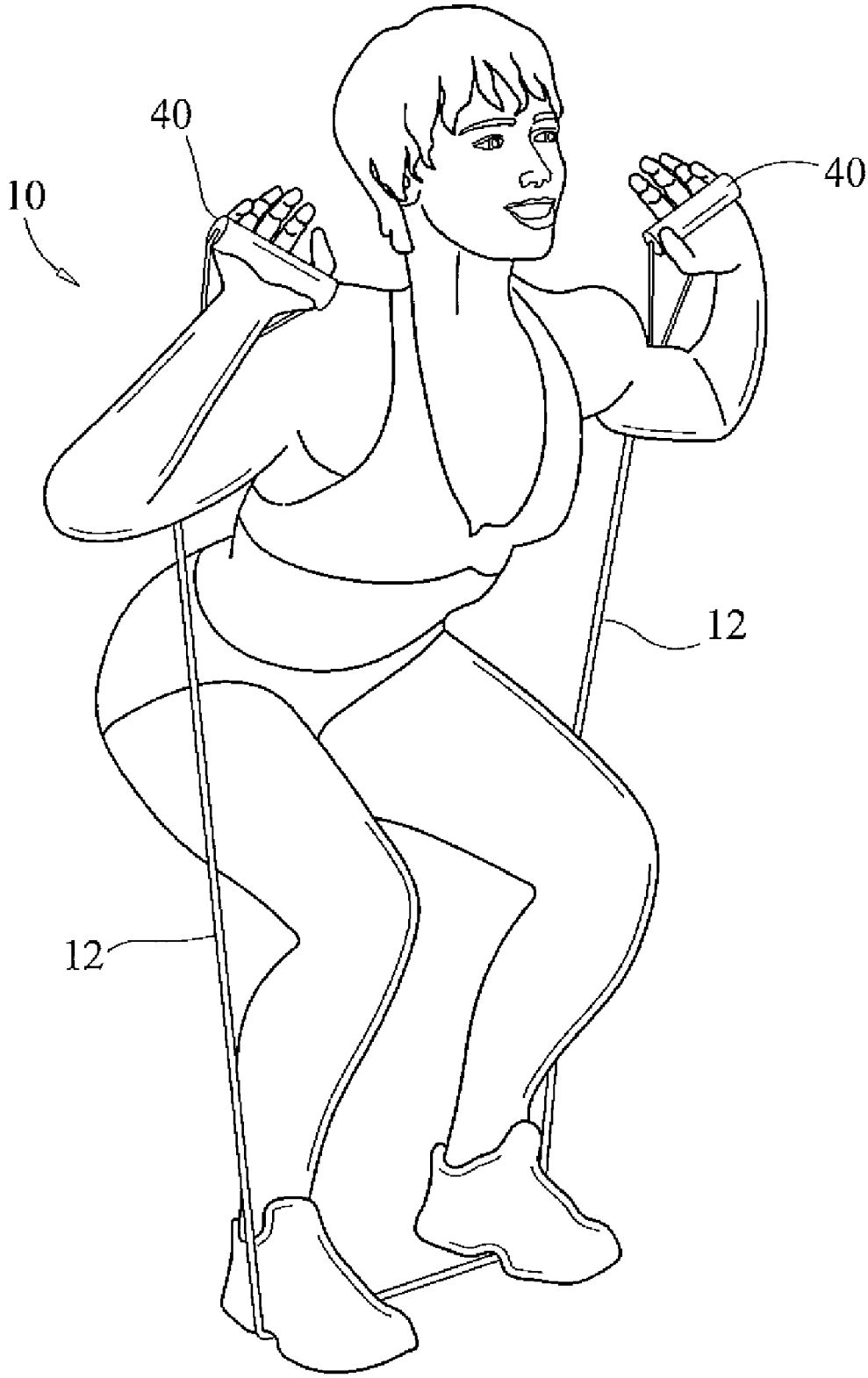
FIG. 9 is a perspective view of the resistance training exercise device with a handle in use in accordance with the preferred embodiment of the instant invention.

With reference to FIGS. 8 and 9, the resistance training exercise method 10 of the instant invention comprises various exercises utilizing one or more cords 12 and one or more handles 40, ankle/wrist straps 50 or anchor straps 60 and anchors 62. The handles 40 are used for stretching the cord with the hands. The straps 40 are mounted to the wrists or ankles for stretching the cord. The anchor strap 60 may be mounted to a hook, door strap or door knob or to an anchor 62, as shown in FIG. 7. The user first determines the exercise to be performed. The user may reference the manual and guide for determining and designing exercise routines. Based on the exercise, the appropriately weighted cord 12 and handles 40 or straps 50 or 60 are selected and clipped to the tether 16 by the clips 30. The cord 12 may be wrapped around a secure stationary object and clipped to itself with the clip 30. The cord 12 may be threaded through a loop of a door or anchor strap 60 and to handles 40 or ankle straps 50. Once the cord 12 is properly prepared, a variety of exercises may be performed by stretching the cord and slowing retracting the cord so as to controllably release tension. For instance, the user may grasp a handle 40 with each hand and stretch and slowly retract the cord's 12 tension across the chest, or stand in the middle of the cord 12 and stretch the cord 12 upward and outward. The user may clip one end of the cord 12 to a door handle or hook and grasp a handle 40 at the other end with one hand while repeatedly stretching the cord 12 with a pulling motion. The user may clip one end of the cord 12 with the clip 30 to a door handle and secure a strap 50 to the other cord clip 30 at the opposite end and place it around an ankle or wrist for repeatedly stretching the cord 12 by moving the leg or arm outward. The cord 12 may be wrapped around a stationary object and secured by engaging the corresponding clip 30 with the cord 12, while a handle 40 or strap 50 is clipped at the opposite end.

Numerous modifications and variations of the present invention are possible in light of the above teachings. It is therefore to be understood that within the scope of the attendant claims attached hereto, this invention may be practiced otherwise than as specifically disclosed herein.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An exercise device comprising:

a stretchable cord having opposing first and second ends, said cord having an internal cavity and an external surface;

at least two plugs, each plug being inserted within said internal cavity of said cord adjacent said first and second ends of said cord;

at least two sleeves, each of said sleeves being placed over said external surface of said cord adjacent said first and second ends of said cord, each of said plugs being situated within a length of each of said sleeves;

at least two tethers, each of said tethers having a stitched portion, said stitched portion forming two opposing compartments, a first compartment having at least one grommet and is designed to received at least one end of said cord with said sleeve and said plug, said grommet having a circumference that is smaller than a circumference of said cord with said sleeve, said plug with at least a portion of said cord and at least a portion of said sleeve being situated generally within said first compartment of said tether;

at least two carabineers, each of said carabineers having a bottom portion and a gate element; and at least two O-rings situated entirely within each of said bottom portions of each of said carabineers, each of said O-rings is designed to receive a portion of said second compartment of each of said tethers.

2. The device of claim 1 wherein said stitched portion is situated generally central of said tether.

3. The device of claim 1 wherein each of said first compartments of said tether forms a loop, each of said loops is placed within each of said O-rings.

4. The device of claim 1 wherein said stitched portion provides for reinforcement in strengthening said tether and said device when said cord is stretched.

5. The device of claim 1 wherein said sleeve, said tether with said compartments and said plug assist in preventing said cord from breaking and snapping during stretching of said cord.

6. The device of claim 1 wherein said plug is situated within said first compartment of said tether and prevents said end of said cord and at least a portion of said sleeve from passing said grommet when said cord is stretched.

7. The device of claim 1 wherein said bottom portion of said carabineer is generally round for fitting said o-ring.

8. A resistance exercise device comprising:

a stretchable cord having opposing first and second ends, said cord having an internal cavity and an external surface;

at least one plug being inserted within said internal cavity of said cord adjacent said first end of said cord;

at least one sleeve being placed over said external surface of said cord adjacent said first end of said cord, said plug being situated within a length of said sleeve;

at least one tether having a stitched portion, said stitched portion forming two opposing compartments, a first compartment having at least one grommet and is designed to received at least one end of said cord with said sleeve and said plug, said plug with at least a portion of said cord and at least a portion of said sleeve being situated generally within said first compartment of said tether, said second compartment forming a loop;

at least one carabineer having a bottom portion and a gate element; and at least one O-ring situated entirely within said bottom portion of said carabineer, said O-ring is designed to receive a portion of said loop of said second compartment of said tether.

9. The device of claim 8 further comprising a second plug and a second sleeve, said second plug being inserted within said internal cavity of said cord adjacent said second end of said cord, said second sleeve being placed over said external surface of said cord adjacent said second end of said cord, said second plug being situated within a length of said second sleeve.

10. The device of claim 9 further comprising a second tether having a stitched portion, said stitched portion forming two opposing compartments, a first compartment having at least one grommet and is designed to received at least one end of said cord with said second sleeve and said second plug, said second plug with at least a portion of said cord and at least a portion of said second sleeve being situated generally within said first compartment of said tether, said second compartment forming a loop.

11. The device of claim 10 further comprising a second carabineer having a bottom portion and a gate element.

12. The device of claim 11 further comprising a second O-ring situated within said bottom portion of said carabineer, said O-rings designed to receive a portion of said loop of said second compartment of said second tether.

13. The device of claim 8 wherein said stitched portion is situated generally central of said tether.

14. The device of claim 8 wherein said stitched portion provides for reinforcement in strengthening said tether and said device when said cord is stretched.

15. The device of claim 8 wherein said sleeve, said tether with said compartments and said plug assist in preventing said cord from breaking and snapping during stretching of said cord.

16. The device of claim 8 further comprises an apparatus designed to be attached to said carabineer for providing multiple exercise options, said apparatus being selected from a group consisting essentially of handles, loops, straps, bands, rings, rope, grips and combinations thereof.

17. The device of claim 8 wherein said tether comprises straps.

18. The device of claim 8 further comprising a plurality of combinable devices to form a system.

19. A resistance exercise device comprising:

a stretchable cord having opposing first and second ends, said cord having an internal cavity and an external surface, each of said first and second ends being folded over itself to create double layered ends;

at least one plug being inserted within said internal cavity of said cord adjacent said first end of said cord, said plug being situated within a length of said double layered cord;

at least one tether having a stitched portion, said stitched portion forming two opposing compartments, a first compartment having at least one grommet and is designed to received at least one end of said cord with said plug, said plug with at least a portion of said cord and at least a portion of said double layered cord being situated generally within said first compartment of said tether, said second compartment forming a loop;

at least one carabineer having a bottom portion and a gate element; and at least one O-ring situated entirely within said bottom portion of said carabineer, said O-ring is designed to receive a portion of said loop of said second compartment of said tether.

* * * * *